US008845802B2

(12) United States Patent
Jattke et al.

(10) Patent No.: US 8,845,802 B2
(45) Date of Patent: Sep. 30, 2014

(54) REFRACTORY COATING FOR PRODUCING MOLD COATINGS

(71) Applicant: Hüttenes-Albertus Chemische Werke GmbH, Düsseldorf (DE)

(72) Inventors: Andreas Stefan Jattke, Hannover (DE); Thomas Linke, Wedemark (DE); Klaus Seeger, Hannover (DE)

(73) Assignee: Hüttenes-Albertus Chemische Werke GmbH, Düsseldorf (DE)

( * ) Notice: Subject to any disclaimer, the term of this patent is extended or adjusted under 35 U.S.C. 154(b) by 0 days.

(21) Appl. No.: 14/132,214

(22) Filed: Dec. 18, 2013

(65) Prior Publication Data

US 2014/0102657 A1 Apr. 17, 2014

Related U.S. Application Data

(62) Division of application No. 13/383,169, filed as application No. PCT/EP2010/055306 on Apr. 21, 2010, now Pat. No. 8,771,412.

(30) Foreign Application Priority Data

Jul. 9, 2009 (DE) ..... 10 2009 032 668

(51) Int. Cl.

| | |
|---|---|
| ***B22C 3/00*** | (2006.01) |
| ***B28B 7/36*** | (2006.01) |
| ***B28B 7/38*** | (2006.01) |
| ***B22C 1/14*** | (2006.01) |

(52) U.S. Cl.

CPC .... *B22C 3/00* (2013.01); *B22C 1/14* (2013.01)
USPC ..... 106/38.22; 106/2; 106/38.2; 106/38.27; 106/38.28; 249/114.1; 249/175

(58) Field of Classification Search

CPC ..... B22C 1/14; B22C 3/00; B22C 9/00; B22C 9/12; B22D 41/02; C08K 7/24; C09D 5/00; C09D 5/18; C09K 21/00
USPC ..... 106/2, 38.2, 38.22, 38.27, 38.28; 249/114.1, 175

See application file for complete search history.

(56) References Cited

U.S. PATENT DOCUMENTS

| | | | | |
|---|---|---|---|---|
| 4,054,435 | A | 10/1977 | Sakane et al. | |
| 5,573,580 | A | 11/1996 | Bartsch et al. | |
| 5,602,063 | A | 2/1997 | Dody et al. | |
| 5,605,063 | A | 2/1997 | Taurog | |
| 2004/0108088 | A1 | 6/2004 | Grassi et al. | |
| 2009/0095439 | A1 * | 4/2009 | Stotzel et al. | 164/520 |

FOREIGN PATENT DOCUMENTS

| | | | |
|---|---|---|---|
| CA | 2610372 | | 11/2006 |
| CN | 101116897 | A | 2/2008 |
| DE | 102005024207 | A1 | 11/2006 |
| JP | S55133843 | | 10/1980 |
| JP | H03291125 | | 12/1991 |
| JP | 2005-169440 | | 6/2005 |
| JP | 2006306010 | A | 11/2006 |
| JP | 2008105082 | A1 | 5/2008 |
| JP | 2009166093 | A | 7/2009 |
| WO | 2003051792 | A2 | 6/2003 |

* cited by examiner

*Primary Examiner* — Anthony J Green
(74) *Attorney, Agent, or Firm* — Duane Morris LLP; J. Rodman Steele, Jr.; Gregory M. Lefkowitz

(57) ABSTRACT

A refractory coating for producing mold coatings by application to inorganically or organically-bound molding materials in lost molds or to cores for iron and steel casting is disclosed. The refractory coating can have a proportion by weight of 0.001% or more and less than 1% of inorganic hollow bodies, which partially or fully consist of crystalline material and have a softening point of 1000° C. or higher.

12 Claims, 1 Drawing Sheet

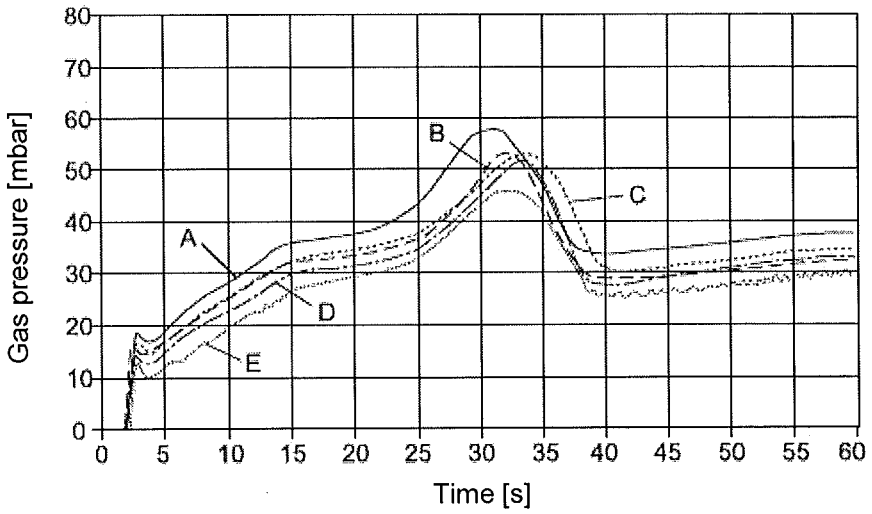
Gas pressure [mbar]
80
70
60
50
40
30
20
10
0
0
5
10
15
20
25
30
35
40
45
50
55
60
Time [s]
A
B
C
D
E

REFRACTORY COATING FOR PRODUCING MOLD COATINGS

CROSS-REFERENCE TO RELATED APPLICATIONS

This application is a divisional of U.S. patent application Ser. No. 13/383,169 filed Jan. 31, 2012, which is a §371 national stage entry of International Application PCT/EP2010/055306, filed Apr. 21, 2010, which claims priority to German Patent Application No. DE 10 2009 032 668.5, filed Jul. 9, 2009, the entire contents of which are incorporated herein by reference.

FIELD OF INVENTION

The present invention relates to a refractory coating (refractory coating agent) for producing mold coatings by application to inorganically or organically-bound molding materials in lost molds or to cores for iron and steel casting.

Casting in a lost mold is a widely-used method for producing near-net-shape parts. Following casting the mold is destroyed and the casting is removed.

BACKGROUND OF THE INVENTION

Molds are negative, they contain the cavity into which pouring takes place resulting in the casting to be produced. The internal contours of the future casting are formed by cores. In the production of the mold a model of the casting to be produced is used to form the cavity in the molding material. Internal contours are represented by cores which are formed in a separate core box. For lost molds and cores in the main refractory, granular materials are used as molding materials such as for example, washed, graded quartz sand. Other molding materials are for example zirconium sands, chromite sands, chamottes, olivine sands, feldspathic sands and andalusite sands. For production of the casting molds the molding materials are bonded with inorganic or organic binding agents. Bentonite or other clays are frequently used as inorganic binding agents. The molding materials are compacted in order to increase the strength. Often, in particular for the production of cores, hardening molding materials bonded with inorganic or organic synthetic in a hot or cold process. Often such molding materials are also gas-flushed for the purpose of curing. The curing of the binding agent can also take place by heating of the molding material and expulsion of a solvent, which then brings about curing.

Normally the surfaces of the molds and cores are coated with a refractory coating. Ready-to-use refractory coatings (refractory coating agents) for coating molds and cores are suspensions of fine-grained, refractory to highly refractory inorganic materials in a carrier fluid, such as water or a solvent. The refractory coating is applied using a suitable application process, such as spraying, immersing, flooding or painting, to the inner contour of the casting mold or to the core and dries onto this so that a coating on the basis of a refractory coating (refractory coating film) results. The drying of the coating on the basis of the refractory coating can take place by addition of heat or radiated energy, e.g. by microwave radiation, or by drying in the ambient air. In the case of refractory coatings containing solvents the drying can also take place by burning off the solvent.

The coatings on the basis of a refractory coating should, inter alia, perform the following functions:

1. Improve the smoothness of the cast surface
2. Allow a clean separation of the liquid metal from the mold 3. Avoid chemical reactions between the molding material and the melt, thereby simplifying the separation of the molding material from the casting
4. Avoid surface defects on the casting, e.g. gas bubbles, penetrations, veining and scaling.

The abovementioned functions 1 through 3 are as a rule performed by combinations of various suitable refractory materials. Refractory here indicates materials and minerals which are able to withstand for a short time the temperature loading during casting of an iron smelt, and highly refractory applies to materials and minerals which are able to withstand for a short time the casting heat of a steel smelt. Examples of refractory materials used are mineral oxides such as corundum, magnesite, quartz, chromite and olivine, as well as silicates such as zirconium silicate, chamotte, andalusite, pyrophyllite, kaolinite, mica and other clay minerals individually or in combination. Graphite and coke are likewise used. The refractory materials are suspended in a carrier fluid. For the carrier fluid, solvents such as ethanol or isopropanol can be used, although these days water is in most cases the preferred carrier fluid.

Other base materials for refractory coatings are suspending agents such as for example clays that are swellable in water such as smectite, attapulgite or sepiolite or swellable organic thickeners such as for example cellulose derivates or polysaccharide. A refractory coating also contains a binding agent, in order to fix the refractory materials to the molding material. As a rule here synthetic resins or synthetic resin dispersions are used such as for example polyvinyl alcohol, poly-acrylate, polyvinyl acetate and corresponding copolymers. Natural resins, dextrins, starches and peptides can also be used as binding agents. The abovementioned swellable clays can likewise perform the functions of the binding agent.

Refractory coatings can contain further additives, in the case of aqueous refractory coatings in particular preservatives and rheologically-acting additives and floating agents. Rheologically acting additives and/or floating agents are used in order to set the desired flow properties of the refractory coating for processing. In the case of aqueous refractory coatings wetting agents can also be used in order to achieve a better wetting of the molding material. A person skilled in the art will be aware of ionic and non-ionic wetting agents. By way of example as an ionic wetting agent dioctyl sulfosuccinates and as a non-ionic wetting agent alkine diols or ethoxylated alkine diols are used Because of the complexity of today's castings the function of coatings on the basis of a refractory coating of avoiding surface defects on the casting is in particular becoming important. Because core geometries are becoming increasingly filigree and the molds ever-more complex, increasing the demands on the molding materials and in particular the refractory coatings. As a result of the thermal expansion of the sand contained in the molding material due to the casting heat inorganic and in particular synthetic resin-bonded molds and cores can rip open so that the liquid metal penetrates the mold or the core. The resultant surface defects, such as veining, can only be removed with difficulty.

During the pyrolysis of synthetic resin-bonded molding materials gases are generated by the casting heat. These can lead to casting defects. In this connection, various causes can be identified that lead to these casting defects which are known as gas defects.

On the one hand gas defects as described by H. G. Levelink, F. P. M. A. Julien and H. C. J. de Man in Gieβerei 67 (1980) 109, can be caused by "exogenous gases". These "exogenous gases" mainly result during the pyrolysis of organic binding agents upon contact with the metal smelt in the mold or the core. These gases create a gas pressure in the molding material, which, if it exceeds the metallostatic counterpressure, can lead to gas defects in the casting, in most cases in the upper area thereof. These gas bubbles as a rule have a smooth inner surface.

A further kind of gas defects is described for example by Gy. Nandori and J. Pal. Miskoloc along with K. Peukert in Gieβerei 83 (1996) 16. Here it is a case of gas bubbles which occur accompanied by slaggy patches. The causes of such gas-slag defects can be seen as exogenous, i.e gases resulting from the molding material and mold cavity, and "endogenous", i.e gases resulting from the smelt. These gases react to some extent with the smelt resulting in oxide-rich slag. Together with the remaining gases this slag causes gas defects. An influencing factor in the formation of these gas defects is the gas permeability of the molding material covered with the coating on the basis of a refractory coating.

At points where the surface of a core or a mold is not adequately protected against the infiltration of smelt, penetrations frequently occur. These defects have to be removed from the casting at great effort.

During the casting process the coating on the basis of a refractory coating can scale off from the core or the mold, if within the core a high gas pressure develops as a result of pyrolysis of the molding material binder and the refractory coating because of a low gas permeability offers a high resistance to this pressure. If the gas pressure here exceeds the adhesion of the coating on the basis of a refractory coating on the core or the mold, then the refractory coatings will scale off. Casting defects as a result of ascending refractory coating particles in the smelt are the result.

Attempts have previously been made to develop refractory coatings which counteract these casting defects. For example, by the addition of platelet-shaped layer silicates such as for example calcinated kaolin, pyrophyllite, talcum and mica or other clay minerals to the refractory coating, coatings on the basis of a refractory coating on the molds or cores result which under the effects of tensile forces deform easily. The individual platelets overlap with one another and are thus able to easily cover cracks which as a result of the thermal expansion of the sand occur in the molding material. Because of their dense texture coatings on the basis of a refractory coating, containing platelet-shaped layer silicates, have only low gas-permeability however. Gases generated during the thermal decomposition of the binding agent of the molding material can then only pass through these layers with difficulty and high gas pressures develop which can lead to the abovementioned gas defects and scaling defects.

Patent application WO 2007/025769 describes refractory coatings (indicated there, together with molding material mixtures, also as molding compounds), containing a borosilicate glass additive in a proportion of at least 0.001%, preferably at least 0.005 wt. %, in particular at least 0.01 wt. % in relation to the solid matter content of the refractory coating. The proportion of borosilicate glass is preferably selected to be less than 5 wt. %, in particular preferably less than 2 wt. % and quite particularly preferably within a range of 0.01 through 1 wt. %, in each case in relation to the solid matter content of the refractory coating. According to a particularly preferred embodiment borosilicate glass in the form of hollow microspheres, that is to say small hollow balls with a diameter of the order of preferably 5 through 500 μm, particularly preferably 10 through 250 μm, the shell of which is made of borosilicate glass, is used. It is assumed that the borosilicate glass under the effect of the temperature of the liquid metal melts and as a result cavities are released which can compensate for the volume expansion of the casting material caused by the casting heat. The softening point of the borosilicate glass is preferably set in the range of less than 1500° C., in particular preferably in the range 500 through 1000° C. If these refractory coatings are used flaking of the coating on the basis of a refractory coating under the influence of the liquid metal occurs only extremely rarely. In addition, it has been found that no veining occurs so that a smooth casting surface is obtained.

Since according to WO2007/025769 melting of the hollow balls of borosilicate glass is intended, after the melting of the hollow balls the coating on the basis of a refractory coating has holes through which the liquid metal can penetrate the surface of the core or the mold. As a result there is a danger of penetration defects. This problem also cannot be solved by using borosilicate glass balls with a higher melting point, for in addition to the network former boroxide glasses also contain so-called network modifiers such as sodium oxide and potassium oxide, wherein all three compounds with practically all the above mentioned constituents of refractory coatings (apart from carbon or graphite), in particular all platelet-shaped clay minerals and silicates, form low-melting compounds. In addition hollow balls in borosilicate glass have only low mechanical stability. Therefore they rupture very easily under compressive loading, which in the production of refractory coatings is unavoidable. A further disadvantage in the use of hollow balls of borosilicate glass is their strong alkalinity. This leads to an unfavorable change in the pH value of the refractory coatings. Therefore according to a variant of the molding compound of WO2007/025769 the addition of an acid or acid source is provided for.

From WO 94/26440 refractory coatings are known which in relation to the weight of the ready-to-use refractory coatings have a content of inorganic hollow balls of 1 through 40%, preferably of at least 4%, or even at least 10%. The hollow balls consist of for example silicates in particular of aluminum, calcium, magnesium and/or zirconium, oxides such as aluminum oxide, quartz, magnesite, mullite, chromite, zirconium oxide and/or titanium oxide, borides, carbides and nitrides and/or zirconium, oxides such as aluminum oxide, quartz, magnesite, mullite, chromite, zirconium oxide and/or titanium oxide, borides, carbides and nitrides such as silicon carbide, titanium carbide, titanium boride, boron nitride and/or boron carbide, or carbon. But hollow balls of metal or glass can also be used. These hollow balls are effective in numerous ways. Thus the dense packing of the base material particles in the refractory coatings, which can be seen as the main cause of the low gas permeability, is relaxed by the small balls and rendered more gas permeable. It is also assumed that at the start of the casting process the insulating properties of the hollow balls and the gas-permeable coatings on the basis of a refractory coating cause a delay in heat transfer through the refractory coating into the molding material. Subsequently the hollow balls melt under the casting heat and/or rupture under the casting pressure, whereby in the coating on the basis of a refractory coating numerous micro-flaws result so that the gas permeability of the coating on the basis of a refractory coating is increased.

BRIEF DESCRIPTION OF THE DRAWINGS

FIG. 1 is a graph of gas pressure versus time for different cores coated with different refractory coatings.

DETAILED DESCRIPTION OF THE INVENTION

Here also, because of the large quantity of melting hollow balls there is the possibility that with an unfavorable overlapping of individual hollow balls in the coating on the basis of a refractory coating holes may form meaning that the casting may have penetration defects.

On the basis of the problems outlined above, it seems advantageous, instead of hollow balls of glass, to use inorganic hollow bodies of materials which have a similar or identical composition to the abovementioned refractory materials, in particular the platelet-shaped refractory materials, that are also contained in the refractory coating, and/or which react only very slowly with the refractory materials contained in the refractory coating. To that end the inorganic hollow bodies should have a high softening point, so that they do not melt during the casting process, along with as higher a mechanical stability as hollow balls of glass. Furthermore, it is desirable to reduce the need for hollow balls without having to accept an increased frequency of casting defects.

These objects are achieved by a ready-to-use refractory coating for producing mold coatings by application to inorganically- or organically-bonded molding materials in lost molds or to cores for iron and steel casting, which contains a proportion by weight of (i) 0.001% or more and (ii) less than 1% of inorganic hollow bodies, wherein the inorganic hollow bodies partially or fully consist of crystalline material.

It has surprisingly been found that in relation to the total weight of the ready-to-use refractory coating just the addition of less than 1% of inorganic hollow bodies, consisting partially or fully of crystalline material, is sufficient to reduce the formation of gas defects, penetrations and veining. Such gas defects occurring in connection with oxide-rich slag are in particular reduced. On the basis of the disclosure in WO 94/26440 this was by no means expected. In the exemplary embodiments indicated there only refractory coatings with a weight-related content of hollow balls of aluminum silicate of at least 4% of the ready-to-use refractory coating, thus four times the lower limit indicated there of 1%, were tested. From the comparison of the exemplary embodiments of WO 94/26440 with the proportions of 0 and 4, 5 and 10% hollow balls of aluminum silicate in the ready-to-use refractory coating it is also clear to see that the gas permeability increases with the proportion of hollow balls, i.e. the advantageous effect of the hollow balls seems to increase the greater the proportion of hollow balls in the ready-to-use refractory coating is.

Preferably, in the refractory coating according to the invention the proportion of inorganic hollow bodies, consisting partially or fully of crystalline material, is in the range 0.001 through 0.99% of the weight of the ready-to-use refractory coating.

A ready-to-use refractory coating means that the matrix of the refractory coating has been thinned with a carrier fluid, such as water, until a suitable suspension results for coating molds or cores using one of the abovementioned techniques to the desired coating thickness. To this end the refractory coatings are thinned with a carrier fluid, such as water, to a suitable viscosity. In the event of application by immersion, the refractory coatings in order to achieve the desired layer thickness of the coating on the basis of a refractory coating of for example 0.1 through 0.6 mm are typically thinned to viscosities of 11.5 sec. through 16 sec. measured in the 4 mm immersion flow cup according to DIN 23211. With other application methods other viscosities will be selected accordingly. Determining the suitable viscosities and layer thicknesses falls within the competences of a person skilled in the art.

The inorganic materials, from which the inorganic hollow bodies are formed, are characterized by the presence of crystalline structures that can be demonstrated by X-ray diffraction analysis. That is to say that within the materials of the hollow bodies there are areas with a three-dimensional periodic arrangement, the extension of which is greater than the coherence length of the X-rays (approximately 10 nm), so that during the X-ray diffraction analysis sharp reflections are observed. The crystalline proportion is preferably 5 wt. % or more, particularly preferably 20 wt. % or more. On the other hand, the material of the hollow balls of borosilicate glass known from WO 2007/025769 is non-crystalline, because glass is an undercooled melt, i.e. it exists in an amorphous state.

The inorganic hollow bodies preferably have a softening point of 1000° C. or higher, preferably 1100° C. or higher, determined with a heating microscope. Particularly preferred are inorganic hollow bodies with a softening point between 1200° C. and 1450° C., determined with a heating microscope. The determination of the softening point and the melting point of ceramics in a heating microscope is based on the measurement of the projection area of a cylindrical sample and the change in this as a function of temperature. The softening point is the temperature at which the first detectable signs of melting occur which manifest as the smoothing of rough surfaces and the start of rounding of edges. The hemisphere temperature or melting point is the temperature at which the sample is deformed into a hemisphere through the formation of melt phases.

The inorganic hollow bodies of the refractory coating according to the invention, consisting partially or fully of crystalline material, contain no boron oxides, which act as network formers for glass, and thus also no borosilicate glass. Compounds such as sodium oxide and potassium oxide, which have the effect of network modifiers, and which also act as fluxing agents and lower the melting temperature, are at most contained as impurities. Therefore in the refractory coatings according to the invention the formation of low melting compounds through reaction of the network modifiers and fluxing agents sodium oxide and potassium oxide and the network former boron oxide with the platelet-shaped clay minerals and silicates normally contained in the refractory coating is eliminated. Preferably in the inorganic hollow bodies to be used according to the invention the content of compounds sodium oxide and/or potassium oxide acting as fluxing agents and network modifiers is preferably less than 4 wt. %.

The inorganic hollow bodies consist of for example silicates, preferably those of aluminum, calcium, magnesium or zirconium, or oxides, preferably aluminum oxide, quartz, mullite, chromite, zirconium oxide and titanium oxide, or carbides, preferably silicon carbide or boron carbide or nitrides, preferably boron nitride, or mixtures of these materials, or mixtures of inorganic hollow bodies of these materials are used.

Hollow bodies means, without being restricted to the spherical shape, any formed three-dimensional structures which have in the interior a cavity which accounts for 15% or more, preferably 40% or more, particularly preferably 70% or more of the volume of the three-dimensional structure. This cavity can be fully enclosed by a shell in an inorganic material, as in the case of hollow balls, or be incompletely enclosed, such as for example in the case of an open-ended tube.

These inorganic hollow bodies are preferably hollow balls with a diameter of less than 400 μm, preferably 10 through 300 μm, particularly preferably 10 through 150 μm.

The inorganic hollow bodies are characterized by a high mechanical stability, so that they are able to withstand the compressive load, which unavoidably occurs in the production of refractory coatings. The inorganic hollow bodies to be used according to the invention have preferably for this purpose compressive strengths of 10 MPa or higher, preferably of 25 MPa or higher. The compressive strength of hollow bodies of glass is as a rule less than 10 MPa. Thus the hollow microspheres used in the exemplary embodiments of WO2007/025769 have a compressive strength of just 4 MPa. The compressive strengths can be determined in an isostatic pressure test in accordance with ASTM D3102-72.

Inorganic hollow bodies are further preferred, in particular hollow balls, with an external diameter of 10 through 150 μm.

Inorganic hollow bodies are also preferred, in particular hollow balls, with a hardness on 5 through 6 on the Mohs scale.

Hollow bodies are in addition preferred, in particular hollow balls with a compressive strength of 25 MPa or more.

Inorganic hollow bodies are likewise preferred, in particular hollow balls, with a cavity that accounts for 70% or more of the total volume of the hollow body or hollow ball.

Individual or all the preferable properties of the inorganic hollow bodies are preferably realized in combination with one another.

Particularly preferably in the refractory coatings according to the invention individual, a majority or all of the inorganic hollow bodies are inorganic hollow balls which form during the combustion of coal in power stations as part of the fly ash. Here these hollow balls are separated from the exhaust gas flow and are referred to as cenospheres (cenospheres CAS No.: 93924-19-7). These inorganic hollow balls preferably have the following features:

an external diameter in the range 10 through 150 μm;
a cavity that accounts for 70% or more of the total volume of the hollow ball;
a softening point of 1200° C. through 1450°;
a hardness of 5 through 6 on the Mohs scale, and
a compressive strength of 25 MPa or higher.

Since the availability of such hollow balls is limited, however, the low content of such inorganic hollow bodies in the refractory coatings according to the invention constitutes an advantage over the prior art according to WO 94/26440.

In a further preferred variant of the refractory coating according to the invention inorganic hollow bodies of carbon are used, preferably nano hollow bodies of carbon, for example carbon nanotubes and/or fullerenes. Mixtures of inorganic hollow bodies of carbon and inorganic hollow bodies of one or a plurality of the other materials mentioned above can also be used.

A ready-to-use refractory coating according to the invention contains:

(a) inorganic hollow bodies, which partially or fully consists of crystalline material,
and preferably
(b) one or a plurality of refractory or highly refractory materials, which are not hollow bodies as defined under (a);
(c) one or a plurality of carrier fluids such as for example water;
(d) one or a plurality of suspending agents such as for example clay minerals that are swellable in water;
(e) one or a plurality of biocides;
(f) optionally one or a plurality of wetting agents;
(g) optionally one or a plurality of floating agents or/and rheological additives;
(h) optionally one or a plurality of binding agents.

For the purposes of calculation of the composition of the refractory coating such substances which can be attributed to more than one of the components (a) through (h) will be attributed to the first mentioned of these components.

The subject matter of the present invention is also the use of a refractory coating according to the invention for producing a coating on a mold or a core for use in casting.

The present invention also relates to a mold or a core for iron and steel casting, wherein the mold or the core on the surface facing towards the casting metal has a coating on the basis of a refractory coating comprising the dried product of a refractory coating according to the invention, wherein the thickness of the coating on the basis of a refractory coating is 0.05 mm or more, preferably 0.15 mm or more and particularly preferably 0.25 through 0.6 mm, and the use of such a mold or such a core for producing an iron or steel casting.

The present invention also relates to a concentrate for producing a ready-to-use refractory coating according to the invention, wherein the concentrate in relation to its total weight has the following composition:

(a) 0.0011 through 3.5% of inorganic hollow bodies, which partially or fully consist of crystalline material;
(b) 20 through 75% of one or a plurality of refractory or highly refractory materials, which are not hollow bodies as defined under (a);
(c) 15 through 80% of one or a plurality of carrier fluids, e.g. water;
(d) 0.1 through 10% of one or a plurality of suspending agents, such as for example clay minerals that are swellable in water;
(e) 0.01 through 0.6% of one or a plurality of biocides;
(f) 0 through 4% of one or a plurality of wetting agents;
(g) 0 through 2% of one or a plurality of floating agents and/or rheological additives;
(h) 0 through 2% of one or a plurality of binding agents.

For the purposes of calculation of the composition of the concentrate those substances which can be attributed to more than one of the components (a) through (h) will be attributed to the first mentioned of these components in each case.

The subject matter of the present invention is also a method for producing a refractory coating from a concentrate according to the invention as described above, wherein the method comprises the following steps:

producing or providing of a concentrate as described above;
mixing of the concentrate with water or another carrier fluid in a mixing ratio such that a ready-to-use refractory coating according to the invention is obtained.

The subject matter of the present invention also relates to a method for producing a coating on the basis of a refractory coating on a mold or core, comprising the following steps:

producing or providing a mold or core to be coated;
providing a ready-to-use refractory coating according to the invention or production of such a refractory coating according to the method according to the invention described above;
applying the ready-to-use refractory coating to the core or the mold, so that a coating on the basis of a refractory coating results with a thickness of 0.05 mm or more, preferably of 0.15 mm or more and particularly preferably of 0.25 mm-0.6 mm.

The refractory coatings according to the invention are for example applied by immersing, flooding, spraying or painting of the lost molds or cores and then preferably dried by the application of heat or microwave radiation, so that on the molds or cores coatings on the basis of a refractory coating are formed.

EXEMPLARY EMBODIMENTS

A refractory coating with the composition shown in Table 1 is produced by mixing of the components with a stirrer and then breaking up by 10 minutes of continuous shearing with a high-speed rotary dissolver. Corresponding production methods will be known to a person skilled in the art and, for example, are described in patent application WO 94/26440.

TABLE 1

| Substance | Refractory coating basic formulation [proportion in wt. %] |
|---|---|
| Water | 53 |
| Aluminum silicate refractory material | 15 |
| Clay mineral | 5.8 |
| Mica | 18 |
| Iron oxide | 1 |
| Graphite | 5 |
| Dextrin | 0.5 |
| Floating agent | 0.5 |
| Preservative | 0.3 |
| Defoaming agent | 0.5 |
| Wetting agent | 0.4 |
| Total | 100 |

From this basic formulation the refractory coatings A, B, C, D and E, the compositions of which are given in Table 2, were produced by mixing with a dissolver disc and thinned with water as indicated, to obtain ready-to-use refractory coatings.

The refractory coatings were applied by immersing cores produced using the cold-box method. The layers thickness of the coatings on the basis of the refractory coatings achieved were 0.5 mm in the wet matted state. Then the cores were dried in the drying oven at 150° C. for 30 minutes. All further investigations were performed with the cores produced and coated with refractory coating in this way (see Table 2). It transpires that when the refractory coatings according to the invention are used on the castings less veining and distortion occurs than when a refractory coating according to the prior art is used with a higher content of inorganic hollow bodies.

TABLE 2

| Substance | Refractory coating A proportion [wt. %] | Refractory coating B proportion [wt. %] | Refractory coating C proportion [wt. %] | Refractory coating D proportion [wt. %] | Refractory coating E proportion [wt. %] |
|---|---|---|---|---|---|
| Basic formulation | 99.5 | 99.5 | 99.5 | 97.0 | 97.0 |
| Water | 0.5 | 0.4 | — | 1.7 | — |
| Ceramic hollow balls (Cenospheres CAS-No. 93924-19-7) | — | 0.1 | 0.5 | 1.3 | 3.0 |
| Total | 100 | 100 | 100 | 100 | 100 |
| Thinning to arrive at the ready-to-use processing state | 1000 g refractory coating + 370 ml water | 1000 g refractory coating + 380 ml water | 1000 g refractory coating + 380 ml water | 1000 g refractory coating + 340 ml water | 1000 g refractory coating + 360 ml water |
| Layer thickness achieved on the core* (in matt state) | 0.5 mm | 0.5 mm | 0.5 mm | 0.5 mm | 0.5 mm |
| Formation of veining, casting trial 1 | | No veining | No veining | No veining | No veining |
| Penetrations, casting trial 2 | | No penetrations | No penetrations | No penetrations | No penetrations |

*Core produced according to the cold box polyurethane process: 70 parts by weight quartz sand, 30 parts by weight chromite sand, 1.8 parts by weight resin components, tertiary amine catalyst.

FIG. 1 shows the results of measurements of the gas pressure as a function of time in each of the abovementioned cores coated with refractory coatings A, B, C, D, or E. The measurement method for determining the gas pressure in cores was described by H. G. Levelink, F. P. M. A. Julien and H. C. J. de Man in Gieβerei 67 (1980) 109. The trial temperature is 1445° C. The composition of the cores is as follows:

50 parts by weight of feldspathic sand;

50 parts by weight of quartz sand;

1.8 parts by weight of resin components.

Surprisingly it transpires that with the refractory coatings B, C and D according to the invention after drying coatings on the basis of a refractory coating on the cores and molds are obtained which despite a higher gas pressure in the molding material than in the comparative trial with refractory coating E reduce the formation of gas defects.

As can be seen from FIG. 1, in the absence of the inorganic hollow bodies in the refractory coating (comparative trial with refractory coating A) the gas pressure in the molding material is considerably higher. From this it follows that just a low quantity, compared to the state of the art (comparative example E) of inorganic hollow bodies in the refractory coatings according to the invention is sufficient in order to reduce the gas pressure far enough for hardly any gas defects to be observed on the castings. It transpires in practice in particular that the occurrence of such gas defects, associated with oxide-rich slag, is sharply reduced. Refractory coatings with higher proportions of hollow balls on the other hand, because of their high gas permeability, in the main counteract exogenous gas bubbles The tests with the refractory coatings of examples B-D show that with the refractory coatings according to the invention advantages at least comparable to those with the refractory coatings according to WO 2007/025769 are achieved, i.e. the formation of veining was reduced and flaking of the coating on the basis of a refractory coating prevented. Furthermore, the formation of penetrations was reduced or prevented.

Cores for the production of engine parts, produced according the cold box method, were coated with a refractory coating according to Example C. In a production batch of 500 parts no exogenous gas defects and in particular also no gas defects associated with slag, were observed.

The invention claimed is:

1. A mold or core for iron and steel casting, wherein the mold or the core on the surface facing towards the casting metal has a coating on the basis of a refractory wash comprising a dried product of a refractory wash, and wherein a thickness of the coating on the basis of the refractory wash is 0.05 mm or more, wherein said refractory wash contains a proportion by weight of 0.001% through 0.99% of inorganic hollow bodies, characterized in that wherein the inorganic hollow bodies in part or in full consist of crystalline material, wherein the refractory wash comprises:

(a) 0.0011 to 3.5 parts by weight of inorganic hollow bodies, which partially or fully consist of crystalline material;

(b) 20 to 75 parts by weight of one or a plurality of refractory materials, which are not hollow bodies as defined under (a);

(c) at least 15 parts by weight of at least one carrier fluid;

(d) 0.1 to 10 parts by weight of one or a plurality of suspending agents;

(e) 0.01 to 0.6 parts by weight of one or a plurality of biocides;

(f) 0 to 4 parts by weight of one or a plurality of wetting agents;

(g) 0 to 2 parts by weight of one or a plurality of floating agents and/or rheological additives; and (h) 0 to 2 parts by weight of one or a plurality of binding agents.

2. A mold or core for iron and steel casting according to claim 1, wherein the thickness of the coating on the basis of the refractory wash is 0.15 mm or more.

3. A mold or core for iron and steel casting according to claim 1, wherein the thickness of the coating on the basis of the refractory wash is 0.25 through 0.6 mm.

4. The mold or core for iron and steel casting of claim 1, wherein the inorganic hollow bodies of component (a) partially consist of crystalline material.

5. The mold or core for iron and steel casting of claim 1, wherein the inorganic hollow bodies of component (a) fully consist of crystalline material.

6. A method of producing an iron or steel casting, comprising providing a mold or core according to claim 1 for production of an iron or steel casting.

7. A concentrate for production of a ready-to-use refractory wash, wherein the concentrate in relation to its total weight has the following composition:

(a) 0.0011 through 3.5% of inorganic hollow bodies, which partially or fully consist of crystalline material;

(b) 20 through 75% of one or a plurality of refractory or highly refractory materials, which are not hollow bodies as defined under (a);

(c) 15 through 80% of one or a plurality of carrier fluids;

(d) 0.1 through 10% of one or a plurality of suspending agents;

(e) 0.01 through 0.6% of one or a plurality of biocides;

(f) 0 through 4% of one or a plurality of wetting agents;

(g) 0 through 2% of one or a plurality of floating agents and/or rheological additives;

(h) 0 through 2% of one or a plurality of binding agents.

8. The concentrate of claim 7, wherein the one or a plurality of carrier fluids comprise water.

9. The concentrate of claim 7, wherein the one or a plurality of suspending agents comprise a clay mineral that is swellable in water.

10. The concentrate of claim 7, wherein the inorganic hollow bodies of component (a) partially consist of crystalline material.

11. The concentrate of claim 7, wherein the inorganic hollow bodies of component (a) fully consist of crystalline material.

12. A method for producing a refractory wash from a concentrate, comprising:

producing or providing a concentrate according to claim 7;

mixing the concentrate with water or another carrier fluid in a mixing ratio in order to produce a ready-to-use refractory wash that contains a proportion by weight of 0.001% through 0.99% of inorganic hollow bodies, wherein the inorganic hollow bodies in part or in full consist of crystalline material.

* * * * *